US006176479B1

(12) United States Patent
Hicklin

(10) Patent No.: US 6,176,479 B1
(45) Date of Patent: Jan. 23, 2001

(54) CLAMPING DEVICE

(76) Inventor: Charles A. Hicklin, 340 Superior St., Hermitage, PA (US) 16148

( * ) Notice: Under 35 U.S.C. 154(b), the term of this patent shall be extended for 0 days.

(21) Appl. No.: 09/480,527

(22) Filed: Jan. 7, 2000

(51) Int. Cl.[7] ..... B25B 1/00
(52) U.S. Cl. ..... 269/156; 269/43; 269/104
(58) Field of Search ..... 269/279, 280, 269/281, 282, 283, 284, 249, 258, 152, 156, 41, 42, 45, 88, 203, 166

(56) References Cited

U.S. PATENT DOCUMENTS

| | | | | |
|---|---|---|---|---|
| D. 162,910 | | 4/1951 | Wallace . | |
| 1,194,666 | * | 8/1916 | Romanowski | 269/156 |
| 1,402,621 | * | 1/1922 | Kesslering | 269/156 |
| 1,497,107 | | 6/1924 | Lasell . | |
| 3,575,405 | | 4/1971 | Harding . | |
| 4,247,090 | * | 1/1981 | Hahn et al. | 269/41 |
| 4,834,352 | | 5/1989 | Thornton . | |
| 4,834,354 | | 5/1989 | Yang . | |
| 4,984,775 | * | 1/1991 | Kahlke | 269/41 |
| 5,067,696 | | 11/1991 | Morley . | |
| 5,443,246 | * | 8/1995 | Peterson | 269/283 |
| 5,697,601 | * | 12/1997 | Gurule | 269/43 |
| 6,098,972 | * | 8/2000 | Klimach | 269/156 |

* cited by examiner

*Primary Examiner*—David A. Scherbel
*Assistant Examiner*—Daniel Shanley

(57) ABSTRACT

A clamping device for allowing the user to easily attach two objects together. The clamping device includes a first arm member having a pair of first elongate members; a second arm member having a pair of second elongate members and being pivotally attached to the first arm member; a mounting bracket securely attached to the first arm member; a third arm member being pivotally attached to the mounting bracket and extending outwardly at an angle from the first and second arm members; a support member being securely attached to the mounting bracket; two driving member supports a first one of which is securely mounted to the support member and a second of which is securely mounted to the first arm member; two threaded driving members a first one which is threaded through the first one of the driving member supports and a second one of which is threaded through the second one of the driving member supports; two arm drive members a first one of which is securely mounted to the second arm member and a second one of which is securely mounted to the third arm member with each arm drive member being engageable by a respective one of the driving members; and three jaw members being securely attached to a respective one of the arm members for gripping about two objects and holding them together.

12 Claims, 4 Drawing Sheets

CLAMPING DEVICE

BACKGROUND OF THE INVENTION

1. Field of the Invention

The present invention relates to a multiple object clamp and more particularly pertains to a new clamping device for allowing the user to easily attach two objects together.

2. Description of the Prior Art

The use of multiple object clamp is known in the prior art. More specifically, multiple object clamp heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,834,354; U.S. Pat. No. 5,067,696; U.S. Pat. No. 1,497,107; U.S. Pat. No. Des. 162,910; U.S. Pat. No. 3,575,405; and U.S. Pat. No. 4,834,352.

While these devices fulfill their respective, particular objectives and requirements, the aforementioned patents do not disclose a new clamping device. The inventive device includes a first arm member having a pair of first elongate members; a second arm member having a pair of second elongate members and being pivotally attached to the first arm member; a mounting bracket securely attached to the first arm member; a third arm member being pivotally attached to the mounting bracket and extending outwardly at an angle from the first and second arm members; a support member being securely attached to the mounting bracket; two driving member supports a first one of which is securely mounted to the support member and a second of which is securely mounted to the first arm member; two threaded driving members a first one which is threaded through the first one of the driving member supports and a second one of which is threaded through the second one of the driving member supports; two arm drive members a first one of which is securely mounted to the second arm member and a second one of which is securely mounted to the third arm member with each arm drive member being engageable by a respective one of the driving members; and three jaw members being securely attached to a respective one of the arm members for gripping about two objects and holding them together.

In these respects, the clamping device according to the present invention substantially departs from the conventional concepts and designs of the prior art, and in so doing provides an apparatus primarily developed for the purpose of allowing the user to easily attach two objects together.

SUMMARY OF THE INVENTION

In view of the foregoing disadvantages inherent in the known types of multiple object clamp now present in the prior art, the present invention provides a new clamping device construction wherein the same can be utilized for allowing the user to easily attach two objects together.

The general purpose of the present invention, which will be described subsequently in greater detail, is to provide a new clamping device which has many of the advantages of the multiple object clamp mentioned heretofore and many novel features that result in a new clamping device which is not anticipated, rendered obvious, suggested, or even implied by any of the prior art multiple object clamp, either alone or in any combination thereof.

To attain this, the present invention generally comprises a first arm member having a pair of first elongate members; a second arm member having a pair of second elongate members and being pivotally attached to the first arm member; a mounting bracket securely attached to the first arm member; a third arm member being pivotally attached to the mounting bracket and extending outwardly at an angle from the first and second arm members; a support member being securely attached to the mounting bracket; two driving member supports a first one of which is securely mounted to the support member and a second of which is securely mounted to the first arm member; two threaded driving members a first one which is threaded through the first one of the driving member supports and a second one of which is threaded through the second one of the driving member supports; two arm drive members a first one of which is securely mounted to the second arm member and a second one of which is securely mounted to the third arm member with each arm drive member being engageable by a respective one of the driving members; and three jaw members being securely attached to a respective one of the arm members for gripping about two objects and holding them together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new clamping device which has many of the advantages of the multiple object clamp mentioned heretofore and many novel features that result in a new clamping device which is not anticipated, rendered obvious, suggested, or even implied by any of the prior art multiple object clamp, either alone or in any combination thereof.

It is another object of the present invention to provide a new clamping device which may be easily and efficiently manufactured and marketed.

It is a further object of the present invention to provide a new clamping device which is of a durable and reliable construction.

An even further object of the present invention is to provide a new clamping device which is susceptible of a low cost of manufacture with regard to both materials and labor, and which accordingly is then susceptible of low prices of sale to the consuming public, thereby making such clamping device economically available to the buying public.

Still yet another object of the present invention is to provide a new clamping device which provides in the apparatuses and methods of the prior art some of the advantages thereof, while simultaneously overcoming some of the disadvantages normally associated therewith.

Still another object of the present invention is to provide a new clamping device for allowing the user to easily attach two objects together.

Yet another object of the present invention is to provide a new clamping device which includes a first arm member having a pair of first elongate members; a second arm member having a pair of second elongate members and being pivotally attached to the first arm member; a mounting bracket securely attached to the first arm member; a third arm member being pivotally attached to the mounting bracket and extending outwardly at an angle from the first and second arm members; a support member being securely attached to the mounting bracket; two driving member supports a first one of which is securely mounted to the support member and a second of which is securely mounted to the first arm member; two threaded driving members a first one which is threaded through the first one of the driving member supports and a second one of which is threaded through the second one of the driving member supports; two arm drive members a first one of which is securely mounted to the second arm member and a second one of which is securely mounted to the third arm member with each arm drive member being engageable by a respective one of the driving members; and three jaw members being securely attached to a respective one of the arm members for gripping about two objects and holding them together.

Still yet another object of the present invention is to provide a new clamping device that allows the user to more quickly attach two objects together.

Even still another object of the present invention is to provide a new clamping device that frees up the user's hands and reduces the amount of time for the user to attach the two objects together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
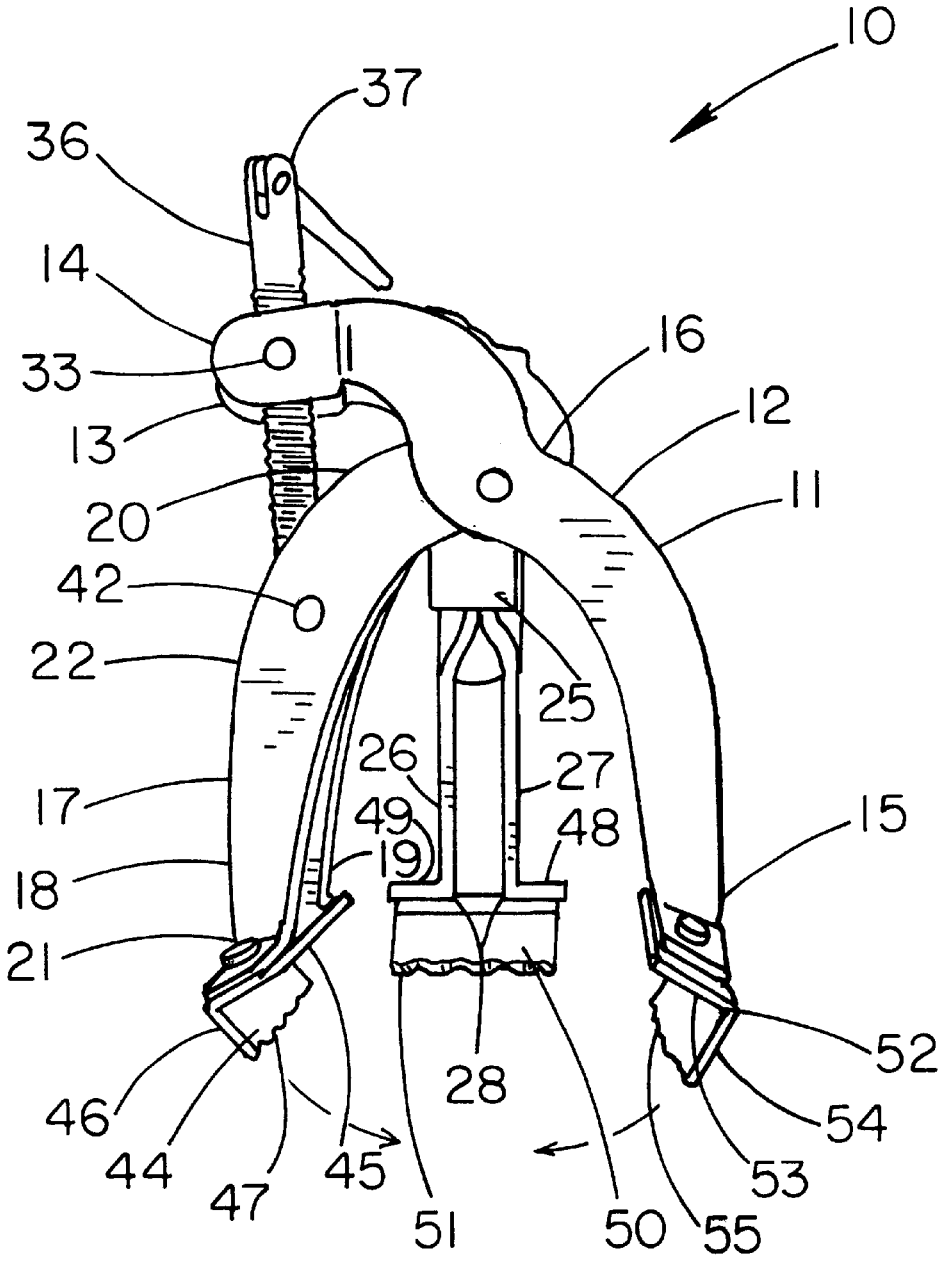
FIG. 1 is a first side elevational view of a new clamping device according to the present invention.
Figure 2:
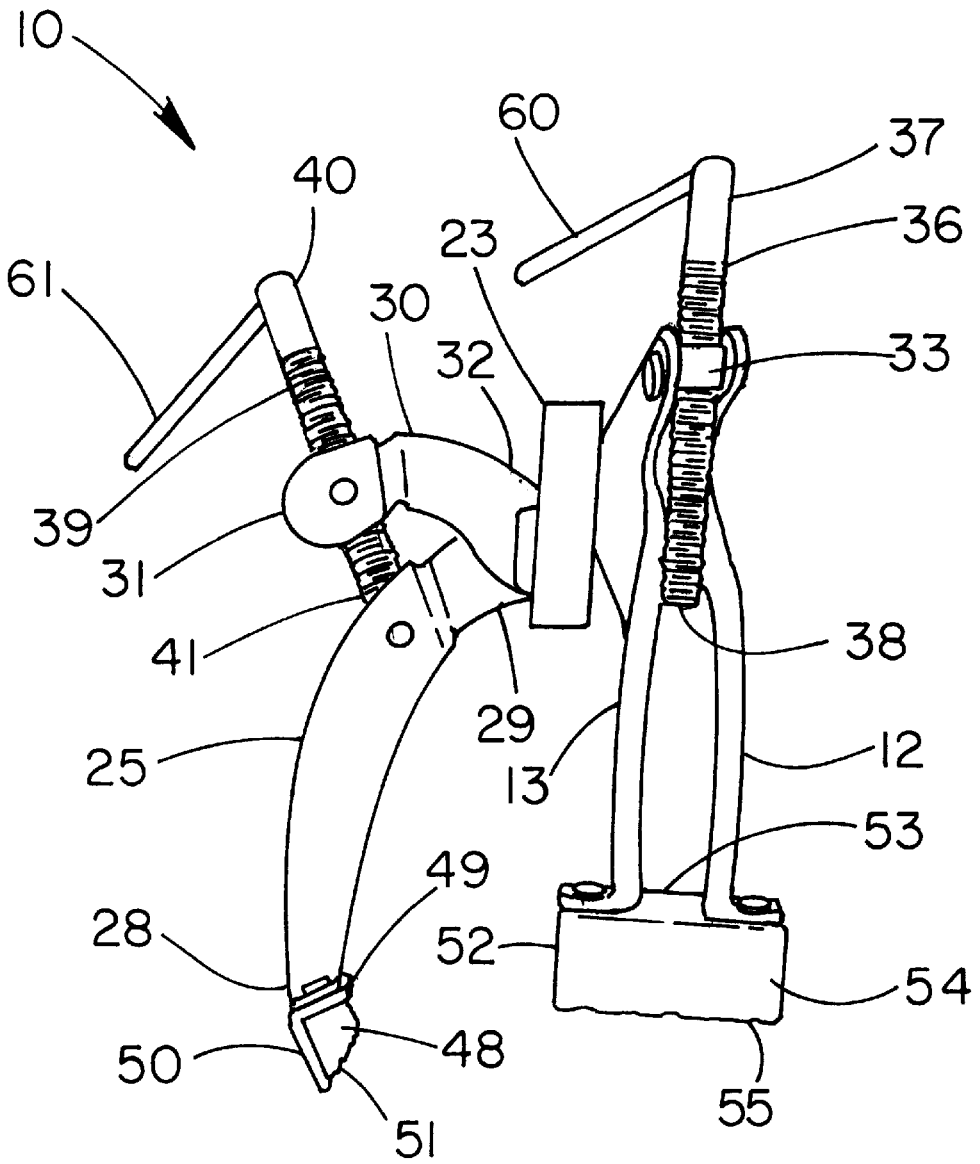
FIG. 2 is a second side elevational view of the present invention.
Figure 3:
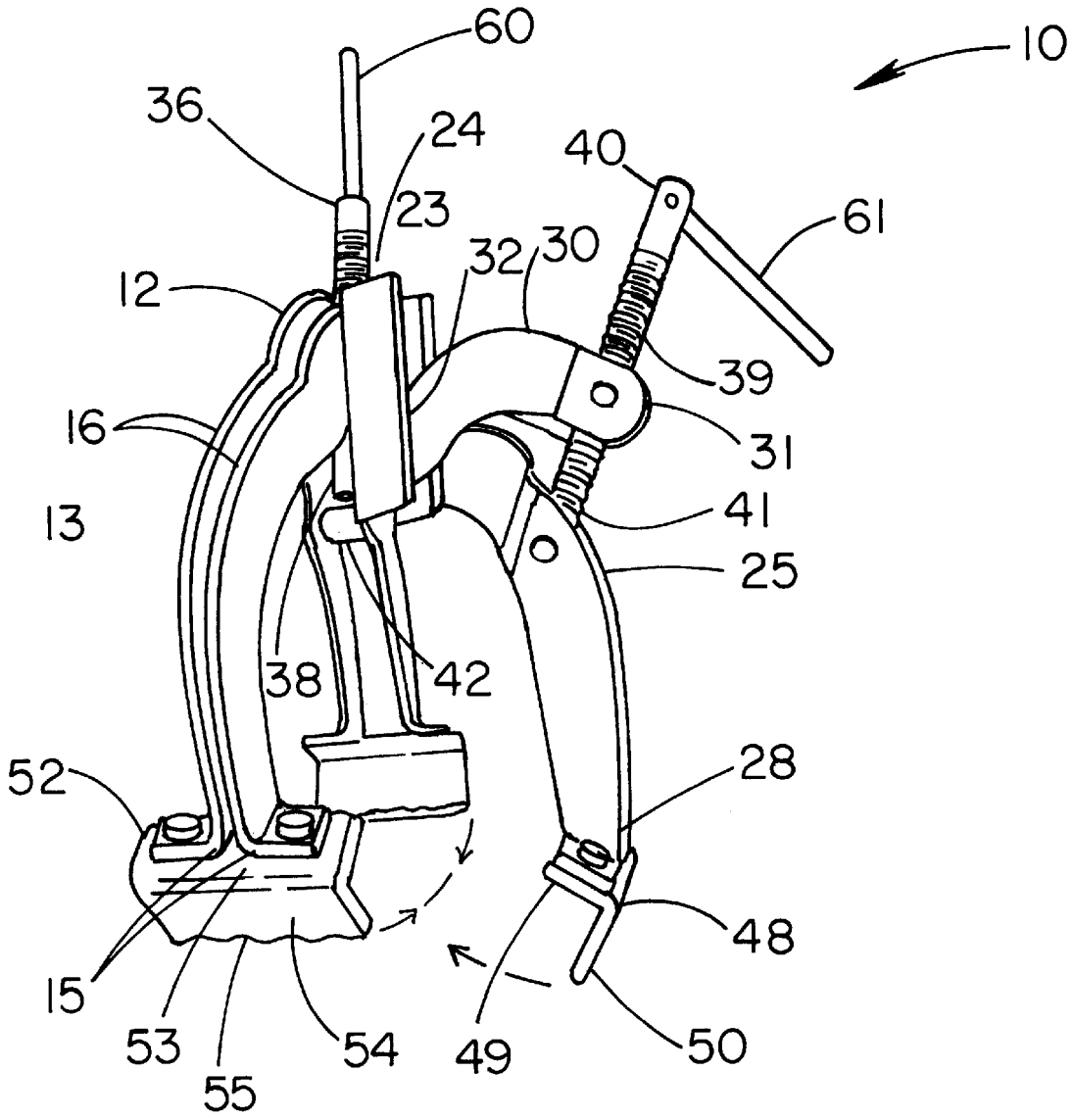
FIG. 3 is a third side elevational view of the present invention.
Figure 4:
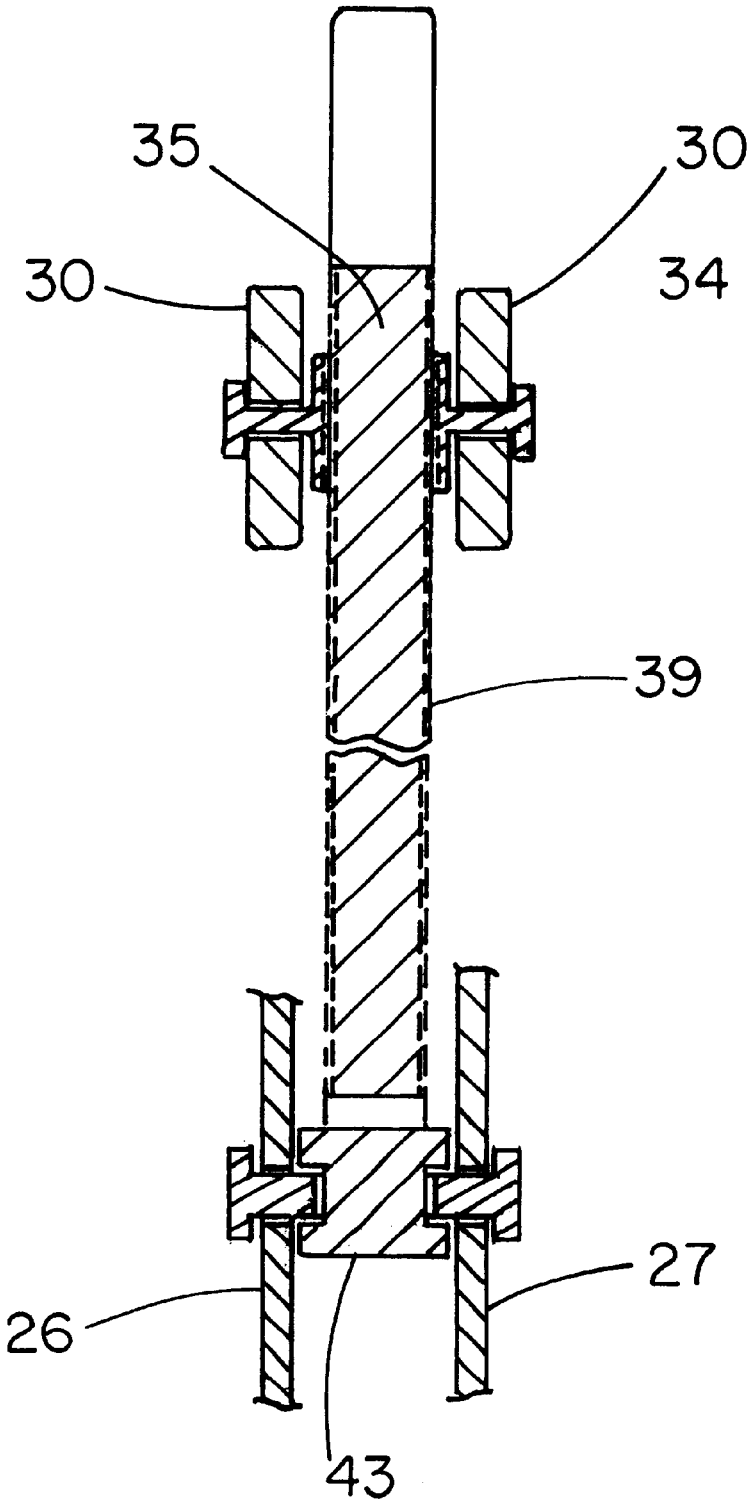
FIG. 4 is a detailed top plan view of one of the threaded driving members and one of the arm drive members and one of the driving member supports of the present invention.

With reference now to the drawings, and in particular to FIGS. 1 through 4 thereof, a new clamping device embodying the principles and concepts of the present invention and generally designated by the reference numeral 10 will be described.

As best illustrated in FIGS. 1 through 4, the clamping device 10 generally comprises a first arm member 11 having a pair of first elongate members 12,13 spaced apart and being interconnected to one another with fasteners. Each of the first elongate members 12,13 has a first end 14, a second end 15, and a central portion 16. The first elongate members 12,13 are disposed parallel to one another. Each of the first elongate members 12,13 has a first arcuate portion extending from the second end 15 to the central portion 16, and further has a second arcuate portion extending from the central portion 16 to the first end 14. The clamping device 10 also includes a second arm member 17 having a pair of second elongate members 18,19 spaced apart and being interconnected to one another with fastener members. Each of the second elongate members 18,19 has a first end 20, a second end 21, and a central portion 22. The first ends 20 of the second elongate members 18,19 are pivotally and conventionally attached to the central portions 16 of the first elongate members 12,13. The second elongate members 18,19 are disposed parallel to one another with each of the second elongate members 18,19 being curved from the first end 20 to the second end 21. A mounting bracket 23 is securely mounted and welded to the central portion 16 of one of the first elongate members 12,13. The mounting bracket 23 includes a centrally-disposed longitudinal slot 24. The clamping device 10 further includes a third arm member 25 having a first end 29, a central portion, and a pair of third elongate portions 26,27 spaced apart and being securely and conventionally attached to the central portion of the third arm member 25. Each of the third elongate members 26,27 has a second end 28. The first end 29 of the third arm member 25 is pivotally and conventionally attached to the mounting bracket 23 and is generally perpendicular to the first and second arm members 11,17 with the third elongate portions 26,27 being disposed parallel to one another and being curved. A support member 30 having a first end 32 and a pair of second ends 31 being spaced apart is securely and conventionally attached to the mounting bracket 23 with the first end 32 of the support member 30 being securely received and attached in the longitudinal slot 24. The support member 30 is curved. The clamping device 10 also includes a plurality of driving member supports 33,34, a first one 34 of which is securely fastened with fastening members to the second ends 31 of the support member 30 and a second one 33 of which is securely fastened with fastening members to the first ends 14 of the first arm member 11; and further includes a plurality of threaded driving members 36,39, a first one 39 of which is threaded through the first one 34 of the driving member supports and a second one 36 of which is threaded through the second one 33 of the driving supports. Each of the driving members 36,39 has a first end

37,40, a second end 38,41, and a handle member 60,61 securely disposed at the first end 37,40. A plurality of jaw members 44,48,52 are securely attached and fastened at the second ends 15,21,28 of the arm members 11,17,25. Each of the jaw members 44,48,52 includes an angled member having a first portion 45,49,53 and a second portion 46,50,54 which is angled relative to the first portion 45,49,53. The second portion 46,50,54 further has a serrated edge 47,51,55 which is directed inwardly of the clamping device 10 for gripping about an object. Further, the clamping device 10 includes a plurality of arm drive members 42,43, a first one 42 of which is securely and conventionally mounted to the second arm member 17 and a second one 43 of which is securely and conventionally mounted to the third arm member 25. The first ends 14 of the first arm member 11 are disposed above the first one 42 of the arm drive members, and the second ends 31 of the support member 30 are disposed above the second one 43 of arm drive members. Each of the driving member supports 33,34 includes a threaded bore 35 extending therethrough for receiving a respective one of the threaded driving members 36,39. The second end 41 of the first one 39 of the driving members is engageable to the second one 43 of the arm drive members for urging the third arm member 25 inwardly of the clamping device 10, and the second end 38 of the second one 36 of the driving members is engageable to the first one 42 of the arm driving members for urging the second arm member 17 toward the first arm members 11.

In use, the three arm members 11,17,25 allows the user to clamp two objects together so that the user can securely attach the objects together. The jaw members 44,48,52 grip about the two objects.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clamping device comprising:

a first arm member having a pair of first elongate members spaced apart and being interconnected to one another, each of said first elongate members having a first end, a second end, and a central portion;

a second arm member having a pair of second elongate members spaced apart and being interconnected to one another, each of said second elongate members having a first end, a second end, and a central portion, said first ends of said second elongate members being pivotally attached to said central portions of said first elongate members;

a mounting bracket being securely mounted to said central portion of one of said first elongate members;

a third arm member having a first end, a central portion, and a pair of third elongate portions spaced apart and being securely attached to said central portion of said third arm member and being perpendicular to said first and second arm members, each of said third elongate members having second ends, said first end of said third arm member being pivotally attached to said mounting bracket;

a support member having a first end and a pair of second ends being spaced apart, said first end of said support member being securely attached to said mounting bracket;

a plurality of driving member supports, a first one of which is securely fastened to said second ends of said support member and a second one of which is securely fastened to said first ends of said first arm member;

a plurality of threaded driving members, a first one of which is threaded through said first one of said driving member supports and a second one of which is threaded through said second one of said driving supports, each of said driving members having a first end and a second end;

a plurality of jaw members each of which is securely attached at said second ends of a respective one of said arm members; and a plurality of arm drive members, a first one of which is securely mounted to said second arm member and a second one of which is securely mounted to said third arm member.

2. A clamping device as described in claim 1, wherein said first elongate members are disposed parallel to one another, each of said first elongate members having a first arcuate portion extending from said second end to said central portion and further having a second arcuate portion extending from said central portion to said first end.

3. A clamping device as described in claim 2, wherein said first ends of said first arm member is disposed above said first one of said arm drive members.

4. A clamping device as described in claim 3, wherein said second elongate members are disposed parallel to one another, each of said second elongate members being curved from said first end to said second end.

5. A clamping device as described in claim 4, wherein said third elongate portions are disposed parallel to one another and are curved.

6. A clamping device as described in claim 5, wherein said mounting bracket includes a centrally-disposed longitudinal slot.

7. A clamping device as described in claim 6, wherein said first end of said support member is securely received and attached in said longitudinal slot, said support member being curved.

8. A clamping device as described in claim 7, wherein said second ends of said support member is disposed above said second one of arm drive members.

9. A clamping device as described in claim 8, wherein each of said driving member supports include a threaded bore extending therethrough for receiving a respective one of said threaded driving members.

10. A clamping device as described in claim 9, wherein said second end of said first one of said driving members is engageable to said second one of said arm drive members for urging said third arm member inwardly of said clamping device, and said second end of said second one of said driving members is engageable to said first one of said arm drive members for urging said second arm member toward said first member.

11. A clamping device as described in claim 10, wherein each of said jaw members include an angled member having a first portion and a second portion which is angled relative to said first portion, said second portion further having a serrated edge for gripping about an object, said jaw member securely attached to said third arm member being perpendicular to said jaw members securely attached to said first and second arm members.

12. A clamping device comprising:

a first arm member having a pair of first elongate members spaced apart and being interconnected to one another, each of said first elongate members having a first end, a second end, and a central portion, said first elongate members being disposed parallel to one another, each of said first elongate members having a first arcuate portion extending from said second end to said central portion and further having a second arcuate portion extending from said central portion to said first end;

a second arm member having a pair of second elongate members spaced apart and being interconnected to one another, each of said second elongate members having a first end, a second end, and a central portion, said first ends of said second elongate members being pivotally attached to said central portions of said first elongate members, said second elongate members being disposed parallel to one another, each of said second elongate members being curved from said first end to said second end;

a mounting bracket being securely mounted to said central portion of one of said first elongate members, said mounting bracket including a centrally-disposed longitudinal slot;

a third arm member having a first end, a central portion, and a pair of third elongate portions spaced apart and being securely attached to said central portion of said third arm member and being perpendicular to said first and second arm members, each of said third elongate members having second ends, said first end of said third arm member being pivotally attached to said mounting bracket, said third elongate portions being disposed parallel to one another and being curved;

a support member having a first end and a pair of second ends being spaced apart, said first end of said support member being securely attached to said mounting bracket, said first end of said support member being securely received and attached in said longitudinal slot, said support member being curved;

a plurality of driving member supports, a first one of which is securely fastened to said second ends of said support member and a second one of which is securely fastened to said first ends of said first arm member;

a plurality of threaded driving members, a first one of which is threaded through said first one of said driving member supports and a second one of which is threaded through said second one of said driving supports, each of said driving members having a first end and a second end;

a plurality of jaw members each of which is securely attached at said second ends of a respective one of said arm members, each of said jaw members including an angled member having a first portion and a second portion which is angled relative to said first portion, said second portion further having a serrated edge for gripping about an object said jaw member securely attached to said third arm member being perpendicular to said jaw members securely attached to said first and second arm members; and a plurality of arm drive members, a first one of which is securely mounted to said second arm member and a second one of which is securely mounted to said third arm member, said first ends of said first arm member being disposed above said first one of said arm drive members, said second ends of said support member being disposed above said second one of arm drive members, each of said driving member supports including a threaded bore extending therethrough for receiving a respective one of said threaded driving members, said second end of said first one of said driving members being engageable to said second one of said arm drive members for urging said third arm member inwardly of said clamping device, and said second end of said second one of said driving members being engageable to said first one of said arm drive members for urging said second arm member toward said first arm member.

* * * * *